United States Patent [19]

Kuwajima et al.

[11] Patent Number: 4,820,555

[45] Date of Patent: Apr. 11, 1989

[54] METALLIC/CLEAR COAT SYSTEM

[75] Inventors: Teruaki Kuwajima, Higashiosaka; Shinichiro Umeda, Kyoto; Hidefumi Okuda, Toyonaka, all of Japan

[73] Assignee: Nippon Paint Co., Ltd., Osaka, Japan

[21] Appl. No.: 26,986

[22] Filed: Mar. 17, 1987

[30] Foreign Application Priority Data

Mar. 17, 1986 [JP] Japan ..... 61-60363

[51] Int. Cl.[4] ..... B05D 3/02

[52] U.S. Cl. ..... 427/407.1; 427/409; 427/410

[58] Field of Search ..... 427/27, 385.5, 388.2, 427/388.4, 407.1, 409, 41 D

[56] References Cited

U.S. PATENT DOCUMENTS

| | | | |
|---|---|---|---|
| 3,639,147 | 2/1972 | Benefiel et al. | 427/409 X |
| 4,139,672 | 2/1979 | Ozawa et al. | 427/27 X |
| 4,220,675 | 9/1980 | Imazaki | 427/27 |
| 4,242,384 | 12/1980 | Andrew et al. | 427/388.4 X |
| 4,403,003 | 9/1983 | Backhouse | 427/407.1 |
| 4,477,536 | 10/1984 | Wright et al. | 427/409 X |
| 4,508,767 | 4/1985 | Hokamura et al. | 427/407.1 |

*Primary Examiner*—Thurman K. Page

*Attorney, Agent, or Firm*—Wenderoth, Lind & Ponack

[57] ABSTRACT

The present invention provide a novel coating method for forming a metallic coat having excellent appearance. The coating method comprises the successive steps of:

(a) coating an article with an sealercoating composition, (b) coating the sealercoated article with an aqueous metallic basecoating composition without curing the sealercoating composition, (c) flashing and/or baking the article obtained in Step (b), (d) coating the article obtained in Step (c) with a thermosetting clear coating composition, and, (e) baking the coated article.

14 Claims, 1 Drawing Sheet

METALLIC/CLEAR COAT SYSTEM

FIELD OF THE INVENTION

The present invention relates to a metallic/clear coat system. More particularly, it relates to a metallic/clear coat system providing a metallic coat having excellent appearance and weather resistance.

BACKGROUND OF THE INVENTION

Figure 2:
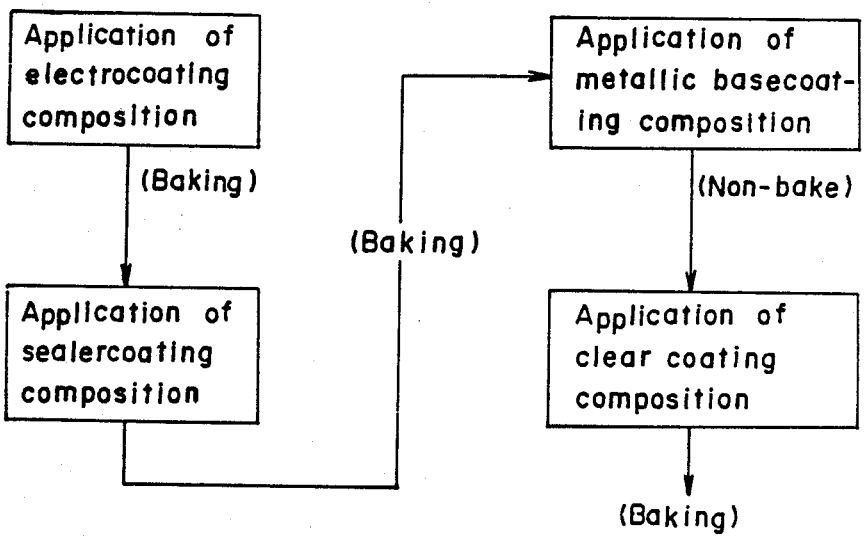
Fig. 2 Prior Art
FIG. 2 is a process drawing showing the conventional coating method for forming a metallic coat on a substrate.

Hitherto, a metallic coat on an article, such as automobile, has been formed by a method which is shown in FIG. 2. This method comprises forming an undercoat by an electrocoating technique; applying a sealercoating composition onto the undercoat followed by curing by heat: then applying a thermosetting type metallic basecoating composition onto the cured sealercoat: next, without curing the metallic basecoating composition, applying a thermosetting type clear coating composition (hereinafter simply referred to as "clear coating composition") onto the metallic coat (so called Wet-On-Wet method); and curing the metallic basecoating composition and clear coating composition by heat. The method is called as Two Coat One Bake method.

Since the clear coating composition is applied by a Wet-On-Wet method, it is required that the metallic basecoating composition while conventionally used has such surface smoothness and quick drying properties that the clear coating composition can be applied on the metallic basecoating composition with keeping the boundary between the metallic basecoating composition and the clear coating composition. Accordingly, the metallic basecoating composition mainly used for this purpose has been a solvent-type. Further, in order to impart uniform and good appearance to the metallic coat, it is required for the metallic basecoating composition to have a decreased viscosity by diluting with an organic solvent. On the other hand, since the use of organic solvents is presently limited from the aspect of air pollution, working atmosphere and resources saving, water becomes more noteworthy as a diluent rather than the organic solvents.

It, however, is difficult to use a metallic basecoating composition for a metallic/clear coating system, because water in the aqueous coating composition does not evaporate sufficiently to impart surface drying properties and surface smoothness to the metallic basecoating composition when spray-coated. For improving these defects, the coating conditions are controlled such as to ensure considerable evaporation of water. Such conditions, however, require a large scaled apparatus and result in a high cost.

Japanese Patent Publication (unexamined) No. 157358/1981 discloses that the viscosity of an aqueous metallic basecoating composition is increased by formulating crosslinked polymer microgels into the metallic basecoating composition. This is not always sufficient in a wide variety of conditions. For example, under such conditions that water is evaporated at a low rate of speed, i.e. at a low temperature and a high humidity, the appearance as of the metallic coat becomes poor. This is because the metallic basecoating composition is often mixed with the clear coating composition as a result of the water contained in the metallic basecoating composition when the clear coating composition is applied, thus disordering the orientation of the metallic pigments and deteriorating the metallic appearance of metallic coat. Accordingly, even in this method, it is still important to dry or cure the metallic coating composition on an article. Also, even if application conditions are good, the molecular weight of the binder resin used in the clear coating composition should be low. The binder resins having high molecular weights, however, tend to be precipitated in the metallic coat thus resulting in a decline of the metallic appearance of the metallic coat. A binder resin having a low molecular weight, however, does not provide sufficient weather resistance and workability (for example, sag resistance).

SUMMARY OF THE INVENTION

The present invention provides a novel coating method for forming a metallic coat having excellent appearance. The coating method comprises the successive (a) coating an article with an sealercoating composition,
(b) coating the sealercoated article with an aqueous metallic basecoating composition without curing the sealercoating composition,
(c) flashing and/or baking the article obtained in Step (b),
(d) coating the article obtained in Step (c) with a thermosetting clear coating composition, and,
(e) baking the coated artile.

According to the present invention, an aqueous metallic basecoating composition can be employed as a basecoating composition, thus saving the use of organic solvents and it provides an improved working atmosphere. In the case where the metallic basecoating composition is applied on the sealercoating composition using the Wet-On-Wet method, metallic pigments are allowed to be arranged in a proper orientation during an application and curing process due to the viscosity of the sealercoating composition, thus providing a smooth surface. Especially, if the sealercoating composition is solvent-type, the sealercoating composition on the article has a high surface tension when contacted with the aqueous metallic basecoating composition, thus minimizing the disorder of the boundary surface between the sealercoat and the metallic coat. This arranges the metallic pigment in proper orientation. Further, since the present invention enhances the adhesion properties both between the sealercoat and metallic basecoat and between the metallic basecoat and clear coat, adhesion properties are considerably enhanced. The present invention also improves surface smoothness, color tone, metallic pigment orientation and the like.

According to the present invention, the energy cost for coating is considerably minimized, because the application of the clear coating composition can be done without baking the metallic basecoating composition, i.e. with simply drying the metallic basecoating composition, after the Wet-On-Wet method. Also, since the basecoating composition is dried, preheated or baked before applying the clear coating composition, the clear coating composition can employ a binder resin having a high molecular weight and therefore provides excellent appearance and weather resistance. Accordingly, the present invention minimizes the use of weather resistance additives, such as a light stabilizer, an antioxidant and a ultraviolet absorber.

DETAILED DESCRIPTION OF THE INVENTION

The sealercoating composition of the present invention is applied between the article and the metallic basecoating composition as a buffer layer in order to enhance the adhesion properties and appearance. The article to be coated is not limited in the present invention, but it includes an untreated steel panel and a pretreated steel panel which is treated by chemicals such as zinc phosphate and then prime-coated by an electrodeposition technique. Any type of sealercoating compositions conventionally used can be used for the present invention and it can be either aqueous- or solvent-type. A resin component contained in the sealercoating composition includes acryl resins, alkyd resins or polyester resins.

The acryl resins are prepared from monomers having a polymerizable unsaturated group in one molecular, for example, carboxyl group containing monomers such as acrylic acid, methacrylic acid, crotonic acid, itaconic acid, maleic acid, fumaric acid and the like; hydroxyl group containing monomers, such as 2-hydroxyethyl acrylate, hydroxypropyl acrylate, 2- hydroxyethyl methacrylate, hydroxypropyl methacrylate, hydroxybutyl acrylate, hydroxybutyl methacrylate, allyl alcohol, methally alcohol and the like: nitrogen containing alkyl (meth)acrylates, such as dimethylaminoethyl acrylate, dimethylaminoethyl methacrylate and the like; polymerizable amides, such as acrylamide, methacrylamide and the like; plymerizable nitriles, such as acrylonitrile, methacrylonitrile and the like; alkyl (meth)acrylates, such as methyl acrylate, methyl methacrylate, ethyl acrylate, ethyl methacrylate, n-butyl acrylate, n-butyl methacrylate, 2-ethylhexyl acrylate and the like; polymerizable aromatic compounds, such as styrene, alpha-methylstyrene, vinyltoluene, t-butylstyrene and the like; alpha-olefines, such as ethylene, propylene and the like: vinyl compounds, such as vinyl acetate, vinyl propionate and the like: diene compounds, such as butadiene, isoprene and the like.

The polyester resins can be prepared by a condensation polymerization of polybasic acids with polyhydric alcohols. Examples of the polybasic acids are dibasic acids, such as oxalic acid, succinic acid, succinic anhydride, adipic acid, azelaic acid, sebacic acid, and the like; aromatic fatty acids, such as phthalic acid, phthalic anhydride, isophthalic acid, terephthalic acid, teterahydrophthalic anhydride, hexahydrophthalic acid, hexahydrophthalic anhydride, tetrabromophthalic anhydride, trimellitic acid, trimellitic anhydride, pyromellitic acid, pyromellitic anhydride, and the like; unsaturated dibasic acids, such as maleic acid, maleic anhydride, fumaric acid, itaconic acid and the like; and a mixture thereof. Examples of the polyhydric alcohols are glycols, such as ethylene glycol, propylene glycol, 1,3-butylene diol, 1,6-hexane diol, diethylene glycol, neopentyl glycol, triethylene glycol and the like; hydrogenated bisphenol A; bisphenol dihydroxypropyl ether; glycelol; trimethylolethane; trimethylolpropane; pentaerythritol; and a mixture thereof. Monobasic acids and monohydric alcohols may be used for the purpose of controlling molecular weight, if desirable.

The alkyd resins are those formed from modifying polyesters with fats and oils, such as drying oils, fatty acids and so on. Concrete examples of the fats and oils are those already known, such as linsead oil, tung oil, oiticica oil, dehydrated castor oil, coconut oil, hydrogenated coconut oil, Cardura E (commercially available from Shell Chemical Company) rice bran fatty acid, tall oil fatty acid, soy bean oil and octyl acid. The alkyd resins can be rosinmodified alkyd resins or phenol resinmodified alkyl resins.

An aqueous sealercoating composition can be generally prepared by indroducing water-soluble groups into the resins mentioned above to form aqueous resins. A process for forming aqueous resin can be carried out by neutralizing acidic groups in the resins with a basic material, such as monomethylamine, dimethylamine, trimethylamine, monoethylamine, triethylamine, monoisopropylamine, diisopropylamine, diethylenetriamine, triethylenetetramine, monoethanolamine, diethanolamine, triethanolamine, monoisopropanolamine, diisopropanolamine, dimethylethanolamine, morpholine, methylmorpholine, piperazine, ammonia, sodium hydroxide, potassium hydroxide, lithium hydroxide and the like. One or two aqueous resins are selected and used for the present invention. Preferred are a water-soluble or water dispersible varnish neutralized with a base from the aspect of workability and solution stability, which are disclosed in Japanese Patent Publication (unexamined) No. 15567/1983.

The sealercoating composition of the present invention is thermosetting type. The thermosetting the sealercoating composition can be prepared by introducing a functional group required for a thermosetting system into the resins by a conventional method. The thermosetting composition can be cured using a crosslinking agent. Examples of the functional groups are a carboxyl group, a sulfonic acid group, a phosphoric acid group, a hydroxyl group, an oxyrane group, an active methylol group, an amino group, a reactive carbon-carbon unsaturated group, an isocyanate group, a blocked isocyanate group, a halogen atom and the like.

As mentioned above, in order to maintain coating conditions constant during the application of the metallic basecoating composition, it is preferred that the sealercoating composition have surface drying properties to a certain extent. When the sealercoating composition is coated, it is preferred that its flowability is small. Since the sealercoating composition is coated by a spray coating method, its flowability of the sealercoating composition is slightly decreased by volatizing a diluent. It, however, is preferred to add resin particles to the sealercoating composition to positively impart thixotoropic properties to it.

The resin particles include resin powder which is prepared by grinding a molten resin into an average particle size of 5 to 50 micron, and resin fine particles having an average particle size of 0.01 to 10 micron which is prepared by an emulsion polymerization process. The resin particles are contained in the sealercoating composition in an amount of 1 to 60 % by weight, preferably 3 to 50 % by weight. When the resin particles are less than 1 % by weight, it may results in the movement of the metallic pigments into the sealercoating composition when the metallic basecoating composition is coated, thus deteriorating its appearance. Amounts more than 60 % by weight may lose smoothness of the sealercoating composition and therefore provides poor appearance.

It is preferred that the ground resin particles are those prepared by melting and grinding the melting mixture of an epoxy resin and a carboxyl group containing resin.

Examples of the epoxy resins are those containing plural epoxy groups and having a solid state at an ambient temperature, preferably a melting point of 40° C., for example bisphenol type epoxy resins such as Epikote 1001, 1004, 1007 (from Shell Chemical Company), Araldite 6071, 6084 (from Chiba Geigy Corporation), DER 660, 661, 664 (from Dow Chemical Company), Epiclone 1050, 4050 (Dainippon Ink & Chemicals, Inc.); phenol novolack type epoxy resins, such as DEN 438 (from Dow Chemical Company): and the like. Epoxy compounds and epoxy derivatives, which are easily produced from the above mentioned epoxy resins, may also be employed. Examples of such epoxy compounds and derivatives are polyol type epoxy resins, alicyclic epoxy resins, halogen containing epoxy resins, polyglycol type epoxy resins, ester type epoxy resins, straight chain aliphatic epoxy resins and the like. The carboxyl group containing resins are those having a solid state at ambient temperature. For improving the disprsity of the ground resin particles, it is preferred that the resins have an acid value of 20 to 300. Examples of the resins are polyesters, acrylic polymers and the like. Grinding can be conducted using a conventional apparatus and method. For example, the resins are mixed in a melting condition and ground after cooling. It is preferred that the ground resin particles can be formulated into an aqueous sealercoating composition.

The resin fine particles are made from an acrylic polymer, a vinyl polymer or a copolymer thereof. The particles usually have an average particle size of 0.01 to 10 micron, preferably 0.02 to 6 micron. The resin fine particles are generally prepared from an emulsion polymerization process. For example, acrylic monomers or vinyl monomers are polymerized in an aqueous solution containing a surfactant and an emulsifying agent in the presence of a polymerization initiator. Preferred are a seed emulsion polymerization and an emulsion polymerization using an oligomer as a core of polymerization. Such an emulsion polymerization process is known to those skilled in the art and a detailed explanation thereof is omitted. Where the particle size is relatively small, for example 0.01 to 0.1 micron, a surfactant and an emulsifying agent are required in a relatively high amount. It is also more preferred that an ampholytic ion compound or resin, as described in Japanese Patent Publication (unexamined) Nos. 21446/1982, 21927/1982, 21464/1982, 40552/1982, 139111/1982, 187301/1982 and 187302/1982, be used together with or instead of the emulsifying agent mentioned above. The polymerization initiator includes an organic peroxide, such as benzoyl peroxide, t-butyl peroxide, cumene hydroperoxide and the like; an organic azo compound, such as azobiscyanovaleric acid, azobisisobutyronitrile, azobis(2,4-dimethyl)valeronitrile, azobis(2-amizinopropane)hydrochloride and the like; an inorganic water-soluble free-radical initiator, such as sodium persulfate, ammonium persulfate, sodium persulfate, hydrogen peroxide and the like; an redox initiator. If necessary, a chain transfer agent can be added to a polymerization system. Examples of the chain transfer agents are mercaptans, such as ethyl mercaptan, butyl mercaptan, dodecyl mercaptan and the like: halogenated carbon, such as carbon tetrabromide, carbon tetrachloride and the like. The resin fine particles may be formed from a crosslinked polymer. For obtaining the crosslinked polymer, functional groups reactive with each other are incorporated into the ethylenically unsaturated monomers. Examples of the combinations of the functional groups are epoxy and carboxyl; amino and carboxyl; epoxy and acid anhydride; amino and acid chloride; alkylene imine and carbonyl; organoalkoxysilane and carboxyl; hydroxyl and isocyanate: and the like. Further, the crosslinked polymer may be prepared by introducing ethylenically unsaturated groups into the polymer. When the sealercoating composition is a solvent type, the crosslinked polymer having ethylenically unsaturated groups are preferably incorporated as one of the resin particles.

In order to enhance corrosion resistance and water resistance, the sealercoating composition may further contain an epoxy resin. The amount of the epoxy resin is 1 to 60 % by weight, preferably 5 to 50 % by weight based on the weight of the main components of the sealercoating composition. The sealercoating composition may also contain additives in a range not preventing the purpose of the present invention. The additives can be either silicone type or nonsilicone type.

Where the resin particles prepared in an aqueous solvent is incorporated into the solvent-type sealercoating composition, the resin particles may be added by substituting the aqueous solvent for a desirable organic solvent (see Japanese Patent Publication (uneamined) Nos. 129065/1983, 129066/1983, and 129069/1983). The solvent-type sealercoating composition may contain an epoxy resin or additives as mentioned in the aqueous sealercoating composition.

The metallic basecoating composition of the present invention can be either a water-soluble type or a water-dispersed type, or either a thermosetting type or a thermoplastic type, as long as it contains water as a main solvent and aluminum, mica or other metallic pigments. Examples of the metallic basecoating compositions are amino-alkyd resin type, amino-acryl resin type, urethane resin type and, acryl-urethane resin type compounds and the like. The metallic basecoating composition may contain an organic solvent in addition to water. The organic solvent used in the present invention includes alcohols, such as methanol, ethanol, n-propanol, isopropanol, n-butanol, isobutanol, sec-butanol, tert-butanol and the like; ketones, such as acetone, methyl ethyl ketone, methyl isobutyl ketone and the like; ethers, such as methyl cellosolve, cellosolve, butyl cellosolve, butyl carbitol and the like; esters, such as methyl cellosolve acetate, cellosolve acetate, butyl cellosolve acetate, ethyl acetate and the like; aromatic hydrocarbons, such as benzene, toluene, xylene and the like; and a mixture thereof. For imparting solubility (including emulsifiability) to the binder resin, the coating composition may further contain amines. Examples of the amines are aliphatic amines, such as diethylamine, triethylamine, n-butylamine, isobutylamine, sec-butylamine, dibutylamine, tributylamine, n-amylamine, sec-amylamine, ethylenediamine, triethylenediamine, diethylenetriamine, hexamethylenediamine and the like; alkanol amines, such as alkanolamines ethanolamine, diethanolamine, dimethlethanolemine and the like. The pigment employed in the metallic basecoating composition includes an aluminum paste, such as AW-500 available from Asahi Chemical Industry Co. Ltd.; a mica pigment, such as an Iriodin series available from Merk Company and the like. The metallic pigment is generally contained in the metallic basecoating composition in combinationwwith a surfactant. An organic or inorganic pigment may also be incorporated in addition to the metallic pigment, if desirable. The metallic basecoating composition may further contain an additive, such as a viscosity modifier, a cissing preventing agent, a color shading preventing agent and the like.

The clear coating composition is one which does not substantially contain a color pigment and a loading pigment and can be an aqueores, solvent; slurry type or powder type. The aqueous clear coating composition can be one which is generally described in the metallic basecoating composition with the exception that the color or loading pigment is not incorporated in it. The solvent-type clear coating composition can be an alkyd resin type an, acryl resin type, a urethane resin type or an acryl-urethane resin type. The slurry type clear coating composition can be an epoxy resin type, an acryl resin type, a polyester resin type, a urethane resin type, a acryl-urethane resin type composition and the like.

The metallic basecoating composition and clear coating composition mentioned above may contain the resin particles mentioned in the sealercoating composition.

Figure 1:
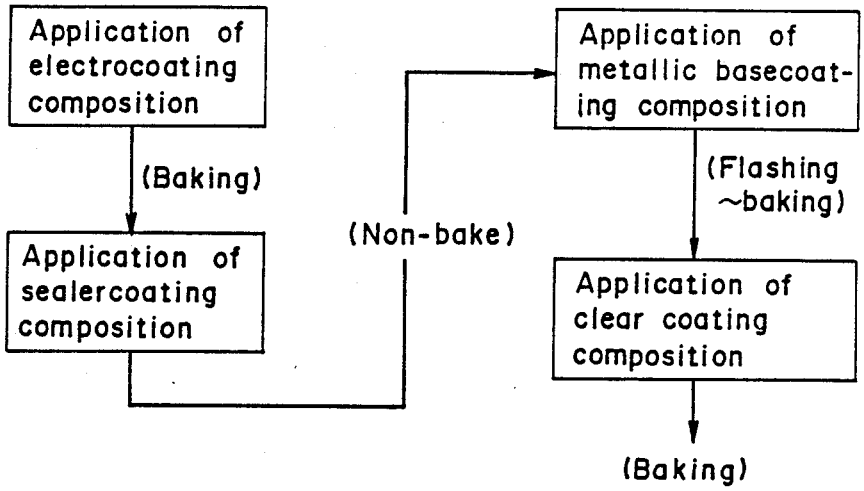
FIG. 1 is a process drawing showing the coating method of the present invention.

According to the present invention, the coating method comprises, as shown in FIG. 1, coating the sealercoating composition, coating the metallic basecoating composition without baking the sealercoating composition, flashing and/or baking the sealercoating composition and metallic basecoating composition and then coating the clear coating composition. A period of interval between the application of the sealercoating composition and the application of the metallic basecoating composition is not limited, but it is preferred from the aspect of appearance and workability that it is set generally at least one minute, preferably 2 to 10 minutes. The sealer-coating composition is positively predried if desired. The conditions of the baking after coating the metallic basecoating composition are not limited, but it is preferred to bake after a period of interval of 5 to 10 minutes. A drying process can be employed instead of the baking. The drying is conducted to a degree not completely curing the metallic basecoating composition, thus to a degree substantially drying up the water in the metallic basecoating composition. However, excess drying and baking wastes energy and deteriorates the adhesion properties between the metallic basecoat and the clear coat. Generally, the drying or baking is conducted at a temperature of 50° to 150° C., preferably 60° to 140° C. for 5 to 40 minutes.

The coating process of the clear coating composition is not limited. It is preferred that, after conducting a period of interval of at 3 minutes, preferably about 7 minutes, the clear coating composition is baked at a temperature of 90° to 200° C., preferably 100° to 160° C. for 10 to 30 minutes. If the baking temperature is too low, it takes more time for curing and often raises a poor curing degree. If the baking temperature is too high, loss of energy would become large.

It is surprising that the method of the present invention can be carried out by using a production facility conventionally used for coating or a small modification thereof. The present invention provides a metallic coat having appearance and good weather resistance by way of baking as the conventional method. Also the method of the present invention effectively prevents surface defects of a clear coat, such as pinhole and sag which are liable to raise because of the volatile components in the metallic basecoating composition.

The present invention is illustrated by the following examples, which, however, are not to be construed as limiting the present invention to their details.

REFERENCE EXAMPLE 1

Production of ân aqueous resin varnish

Seventy six parts by weight of ethylene glycol monobutyl ether was charged in a one liter reaction vessel having a stirrer, a temperature controller and a condenser, to which 61 parts by weight of a monomer solution prepared by mixing 45 parts by weight of styrene, 63 parts by weight of methyl methacrylate, 48 parts by weight of 2-hydroxyethyl methacrylate, 117 parts by weight of n-butyl acrylate, 27 parts by weight of methacrylic acid, 3 parts by weight of laurylmercaptane and 3 parts by weight of azobisisobutyronitrile was added and heated to 120° C. with stirring. After adding 245 parts by weight of the remaining monomer solution over 3 hours, the mixture was mixed for 1 hour. Twenty eight parts by weight of dimethylethanolamine and 200 parts by weight of deionized water were added to the resultant mixture to obtain an aqueous acryl resin varnish having a nonvolatile content of 50 % and a number average molecular weight of 6,000.

REFERENCE EXAMPLE 2

Production of an aqueous resin varnish

An aqueous acryl resin varnish was prepared as generally described in Reference Example 1 with the exception that 5 parts by weight of lauryl mercaptan and 7 parts by weight of azobisisobutylonitrile were employed. The acryl resin varnish had a nonvolatile content of 50 % and a number average molecular weight of 3,000.

REFERENCE EXAMPEL 3

Production of a modified epoxy resin

A two liter flask having a stirrer, a condenser and a temperature controller was charged with 73.5 parts by weight of sodium salt of taurine, 100 parts by weight of ethylene glycol and 200 parts by weight of ethylene glycol monoethyl ether and heated to 120° C. with stirring. A solution containing 470 parts by weight of Epikote 1001 (diglycidyl ether of bisphenol A having an epoxy equivalent of 470; commercially available from Shell Chemical Company) and 400 parts by weight of ethylene glycol monoethyl ether was added for 2 hours. After the completion of the addition, stirring was continued with heating for 20 hours. Hydrochloric acid was added to the resultant solution to precipitate a modified epoxy resin. The modified epoxy resin was purified by a reprecipitation method using ethylene glycol monoethyl ether and water to obtain 205 parts by weight of the modified epoxy resin.

The resin had an acid value of 48.6 and a sulfur content using an X-ray fluorometry of 3 %.

REFERNCE EXAMPLE 4

Production of resin particles

A one liter reaction vessel having a stirrer, a condenser and a temperature controller was charged with 306 parts by weight of deionized water, 6 parts of the modified epoxy resin of Reference Example 3 and 0.8 parts of dimethylaminoethanol, and heated to 80° C. with stirring. A solution containing 4.8 parts by weight of azobiscyanovaleric acid, 4.56 parts by weight of dimethylaminoethanol and 48 parts by weight of deionized water was added to the resultant mixture while maintaining 80° C. with stirring, and a mixture solution containing 81 parts by weight of styrene, 81 parts by weight of methyl methacrylate, 108 parts by weight of n-butyl acrylate and 30 parts by weight of 2-hydroxyethyl acrylate was added for 60 minutes. Next, another mixture containing 1.2 parts by weight of azobiscyanovaleric acid, 1.14 parts by weight of dimethylaminoethanol and 12 parts by weight of deionized water was added while maintaining 80° C. and continued to mix for 60 minutes to obtain an emulsion having a nonvolatile content of 45 %, a pH of 7.2, a viscosity of 96 cps and an average particle size of 0.065 micron.

The obtained emulsion was subjected to a spray dry process to remove water to obtain resin particles. The resin particles were dispersed in xylene to obtain a xylene dispersion having a nonvolatile content of 30 %.

REFERENCE EXAMPLE 5

Preparation of ground resin particles

Ground resin particles were prepared from the following ingredients:

| Ingredients | Parts by weight |
|---|---|
| Epoxy resin particles[1] | 44 |
| Carboxyl group containing resin particles[2] | 56 |

[1]Available from Shell Chemical Company as Epikote 1004
[2]Available from Dainippon Ink & Chemical Co. Ltd as Finedic M 6103.

The ingredients were mixed in a container for premixing and then melted in a kneader at 95° C. After cooling, the resin mixture was ground and passed through a 150 mesh sieve to obtain resin powder having an average particle size of not more than 100 micron.

PRODUCTION EXAMPLE 1

Preparation of a sealercoating composition

| Ingredients | Parts by weight |
|---|---|
| Aqueous resin varnish of Reference Example 1 | 138 |
| Resin particles of Reference Example 5 | 99 |
| Rutile titanium dioxide | 136 |

The ingredients were charged in a one liter stainless vessel to which a suitable amount of deionized water was added and dispersed at room temperature for one hour in a paint conditioner to form a white pigment paste. Ten parts by weight of a melamine resin (hexamethoxymethylol melamine having a nonvolatile content of 100 % by weight, commercially available from Mitsui Toatsu Chemicals Inc. as Cymel 303) and 120 parts by weight of deionized water were added to the white pigment paste and dispersed for 20 minutes at room temperature by using a laboratory mixer to obtain a white coating composition.

PRODUCTION EXAMPLE 2

Preparation of a solvent type sealercoating

| Ingredients | Parts by weight |
|---|---|
| Acryl resin[1] | 76 |
| Resin particles of Reference Example 4 | 6.84 |
| Rutile titanium dioxide | 190 |
| Xylene | 76 |
| Solvesso #100[2] | 38 |

[1]Available from Mitsui Toatsu Chemicals Inc. as Aromatics NTU-64 which has a nonvolatile content of 50% by weight.
[2]A solvent available from Shell Chemical Company.

The ingredients were charged in a 100 ml stainless vessel and disperse at room temperature for 45 minutes in a paint conditioner to form a white pigment paste.

266 parts by weight of Aromatics NTU-64 mentioned above and 95 parts by weight of a melamine resin (butoxy melamine having a novolatile content of 60 % by weight, commercially available from Mitsui Toatsu Chemicals Inc. as U-van 20N) were added to the white pigment paste and dispersed for 30 minutes at room temperature by using a laboratory mixer to obtain a white solvent type sealercoating composition.

PRODUCTION EXAMPLE 3

Preparation of an aqueous metallic basecoating

| Ingredients | Parts by weight |
|---|---|
| Aluminum paste[1] | 6.92 |
| Deionized water | 3.46 |

[1]Aluminum content 65%.

The ingredients were mixed at room temperature for 15 minutes in a laboratory mixer. After adding 3.46 parts by weight of deionized water and 10 parts by weight of the aqueous resin varnish of Reference Example 1, the mixture was mixed for 30 minutes.

Sixty parts by weight of the aqueous resin varnish mentioned above, 15 parts by weight of a melamine resin (methoxy methylol melamine having a nonvolatile content of 100 % by weight, commercially available from Mitsui Toatsu Chemicals Inc. as Cymel 303) and 82.83 parts by weight of deionized water were added to the white pigment paste and dispersed for 30 minutes to obtain an aqueous metallic basecoating composition.

PRODUCTION EXAMPLE 4

Preparation of a solvent type clear coating

| Ingredients | Parts by weight |
|---|---|
| Acryl resin[1] | 120 |
| Butyled melamine[2] | 42.86 |
| Xylene | 5.71 |
| Solvesso #150 | 2.85 |

[1]Available from Dainippon Ink & Chemicals Inc. as Acrydic 57-748 which has a nonvolatile content of 50% by weight.
[2]Available from Mitsui Toatsu Chemicals Inc. as U-20N-60 which has a nonvolatile content of 60% by weight.

The ingredients were mixed at room temperature for 20 minutes in a laboratory mixer to obtain a solvent type clear coating composition.

PRODUCTION EXAMPLE 5

Preparation of an aqueous clear coating composition

| Ingredients | Parts by weight |
|---|---|
| Aqueous resin varnish of Reference Example 2 | 70 |
| Cymel 303 | 15 |
| Deionized water | 57.86 |

The ingredients were mixed at room temperature for 30 minutes in a laboratory mixer to obtain an aqueous clear coating composition.

PRODUCTION EXAMPLE 6

Preparation of an aqueous clear coating composition

| Ingredients | Parts by weight |
|---|---|
| Aqueous resin varnish of Reference Example 1 | 70 |
| Cymel 303 | 15 |
| Deionized water | 57.86 |

The ingredients were mixed at room temperature for 30 minutes in a laboratory mixer to obtain an aqueous clear coating composition.

PRODUCTION EXAMPLE 7

Preparation of an aqueous sealercoating composition

| Ingredients | Parts by weight |
|---|---|
| Aqueous resin varnish of Reference Example 1 | 76 |
| Rutile titanium dioxide | 190 |

The ingredients were charged in a one liter stainless vessel was added and dispersed at room temperature for 45 minutes in a paint conditioner to form a white pigment paste.

266 parts by weight of the aqueous resin varnish mentioned above and 57 parts by weight of a melamine resin (hexamethoxymethylol melamine having a nonvolatile content of 100 % by weight, commercially available from Mitsui Toatsu Chemicals Inc. as Cymel 303) were added to the white pigment paste and dispersed for 30 minutes at room temperature by using a laboratory mixer to obtain a white aqueous sealercoating composition.

EXAMPLE 1

Step A: The solvent type sealercoating composition of Production Example 2 was diluted by xylene to a viscosity of 25 second which was measured by No. 4 Ford Cup at 25° C. The diluted coating composition was applied twice to a steel panel by an air spray method. A period of interval between the first and second applications was 1 minute. Another period of interval of 3 minutes was set after the second application and then the aqueous metallic basecoating composition of Production Example 3 diluted to a viscosity of 30 second (No. 4 Ford Cup at 25° C.) by deionized water was applied twice to the steel panel. Between two applications of the metallic basecoating composition, the period of interval was 1 minute. After setting a period of interval of 5 minutes subsequent to the second application of the metallic basecoating composition, the obtained panel was baked at a temperature of 135° to 140° C. for 30 minutes. The thickness of the sealercoat was 35 micron and the thickness of the metallic basecoat was 20 micron after baking.

Step B: The panel obtained in Step A was spraycoated twice with the solvent type clear coating composition which was diluted with Solvesso #100 to a viscosity of 25 second (No.4 Ford Cup at 25° C.). A period of interval of 1 minute was set between two applications. Subsequent to the second application of the clear coat, a period of interval of 7 minutes was set and the panel was baked at 135° to 140° C. for 30 minutes. The thickness of the clear coat was 40 micron after baking. The metallic coat obtained by the above mentioned metallic/clear coat system had an excellent appearance. The evaluation of the metallic coat was made and its result was shown in Table 1.

EXAMPLE 2

Step A: A steel panel was coated with the solvent type sealercoating composition of Production Example 2 and the aqueous metallic basecoating composition of Production Example 3, as generally described in Example 1. The coating compositions were iiluted as described in Example 1. After setting a period of interval of 5 minutes subsequent to the second application of the metallic basecoating composition, the obtained panel was baked at a temperature of 135° to 140° C. for 30 minutes.

Step B: The panel obtained in Step A was spraycoated twiqe with the aqueous clear coating composition which was diluted with deionized water to a viscosity of 30 second (No.4 Ford Cup at 25° C.). A period of interval of 1 minute was set between two applications. Subsequent to the second application of the clear coating composition, a period of interval of 7 minutes was set and the panel was baked at 135° to 140° C. for 30 minutes. The resultant metallic coat had excellent appearance. The evaluation of the metallic coat was made and its result was shown in Table 1.

EXAMPLE 3

Step A: The aqueous sealercoating composition of Production Example 1 was diluted by deionized water to a viscosity of 30 second which was measured by No. 4 Ford Cup at 25° C. The diluted coating composition was applied twice to a steel panel by an air spray method. A period of interval between the first and second applications was 1 minute. Another period of interval of 3 minutes was set after the second application and then the diluted aqueous metallic basecoating composition of Production Example 3 was applied twice to the steel panel, as generally described in Example 1. Between two applications of the metallic basecoating composition, a period of interval was 1 minute. After setting a period of interval of 5 minutes subsequent to the second application of the metallic basecoating composition, the obtained panel was baked at a temperature of 135° to 140° C. for 30 minutes.

Step B: The panel obtained in Step A was spraycoated twice with the aqueous clear coating composition of Production Example 6 which was diluted with deionized water to a viscosity of 30 second (No.4 Ford Cup at 25° C.). A period of interval of 1 minute was set between two applications. Subsequent to the second application of the clear coating composition, a period of interval of 7 was set and the panel was baked at 135° to 140° C. for 30 minutes. The evaluation of the metallic coat was made and its result was shown in Table 1.

EXAMPLE 4

Step A: A steel panel was coated with the aqueous sealercoating composition of Production Example 1 and the aqueous metallic basecoating composition of Production Example 3, as generally described in Example 3. The coating compositions were diluted as described in Example 1. A period of interval of 30 minutes was set at 40° C. subsequent to the second application of the metallic basecoating composition.

Step B: The panel obtained in Step A was spray-coated twice with the aqueous clear coating composition which was dilute with deionized water to a viscosity of 30 second (No.4 Ford Cup at 25° C.). A period of interval of 1 minute was set between two applications. Subsequent to the second application of the clear coating composition, a period of interval of 7 minutes was set and the panel was baked at 135° to 140° C. for 30 minutes. The resultant metallic coat had an excellent appearance. The evaluation of the metallic coat was made and its result was shown in Table 1.

EXAMPLE 5

An application test was carried out as generally described in Example 3 with the exception that the aqueous sealercoating composition of Production Example 7 was employed instead of that of Production Example 3. The result of the test was shown in Table 1.

COMPARATIVE EXAMPLE 1

Step A: The solvent type sealercoating composition of Production Example 2 was diluted by xylene to a viscosity of 25 second which was measured by a No. 4 Ford Cup at 25° C. The diluted sealercoating composition was applied twice to a steel panel by an air spray method. A period of interval between the first and second applications was 1 minute. After setting a period of interval of 5 minutes subsequent to the second application of the sealercoating composition, the obtained panel was baked at a temperature of 135° to 140° C. for 30 minutes.

Step B: The panel obtained in Step A was spray-coated twice with the aqueous clear coating composition which was diluted with deionized water to a viscosity of 30 second (No.4 Ford Cup at 25° C.). A period of interval of 1 minute was set between two applications. Subsequent to the second application of the clear coating composition, a period of interval of 7 minutes was set and the panel was baked at 135° to 140° C. for 30 minutes. The thickness of the clear coat was 40 micron after baking. The evaluation of the metallic coating was mae and its result was shown in Table 1.

COMPARATIVE EXAMPLE 2

Step A: The aqueous metallic basecoating composition of Production Example 3 was diluted with xylene to a viscosity of 25 seconds which was measured by a No. 4 Ford Cup at 25° C. The diluted metallic basecoating composition was applied twice to the dried panel obtained in Step A of Comparative Example 1 by an air spray method. A period of interval between the first and second applications was 1 minute. Another period of interval of 3 minutes was set after the second application and then the solvent type clear coating composition of Production Example 10 diluted to a viscosity of 25 second (No. 4 Ford Cup at 25° C.) by Solvesso #100 was applied twice to the steel panel. Between two applications, a period of interval was 1 minute. After setting a period of interval of 7 minutes subsequent to the second application of the clear coating composition, the obtained panel was baked at a temperature of 135° to 140° C. for 30 minutes. The evaluation of the metallic coatings was made and its result was shown in Table 1.

TABLE 1

| | Appearance[1] | Adhesion properties[2] | Weather resistance[3] |
|---|---|---|---|
| Example 1 | ◎ | 0/100 | 97 |
| Example 2 | ◎ | 0/100 | 97 |
| Example 3 | ◎ | 0/100 | 98 |
| Example 4 | ◎ | 0/100 | 97 |
| Example 5 | ◎ | 0/100 | 94 |
| Comparative Example 1 | X | 20/100 (Sealer-coat/Metallic basecoat) | 90 |
| Comparative Example 2 | X | 15/100 (Sealer-coat/Metallic basecoat) | 15 |

[1]Evaluation is made by sight:
○: excellent
◎: good
X: poor.
[2]A metallic basecoat was crossly notched at intervals of 1 mm with an NT cutter to form 100 aquares. and a Scotch tape was applied to the metallic basecoat and removed. Adhession properties was evaluated by the number of the removed squares.
[3]60° gloss retention is measured after putting into Sunshine Weather-O-Meter for 2,000 hours.

What is claimed is:

1. A coating method for forming a metallic coat comprising the successive steps of:

(a) coating an article with an electrocating composition and baking it, (b) coating the thus-baked article with a sealer coating composition, (c) coating the sealer coated article with an aqueous metallic base coating resinous composition without curing the sealer coating composition, (d) flashing and/or baking the article obtained in Step (c), (e) coating the article obtained in Step (d) with a thermosetting clear coating resinous composition, and, (f) baking the coated article.

2. The coating method according to claim 1, wherein the sealercoating composition is an capable of being dispersed in an organic solvent or water.

3. The coating method according to claim 1 wherein the sealercoating composition further contains resin particles in an amount of 1 to 60 % by weight.

4. The coating method according to claim 3 wherein the resin particles are resin powder which is prepared by grinding a molten resin into an average particle size of 5 to 50 micron.

5. The coating method according to claim 3 wherein the resin particles are resin fine particles having an average particle size of 0.01 to 10 micron.

6. The coating method according to claim 3 wherein the sealercoating composition is an aqueous coating composition containing the ground resin powder and the thermosetting clear coating resinous composition is capable of being dispersed in an organic solvent or water.

7. The coating method according to claim 3 wherein the sealercoating composition contains the resin fine particle having a particle size of 0.01 to 10 micron and the the thermosetting clear coating resinous composition is capable of being dispersed in an organic solvent or water.

8. A method according to claim 6, wherein the metallic base coating resinous composition contains a resin selected from the group consisting of amino-alkyl resins, amino-acryl rsins, urethane resins and acryl-urethane resins.

9. A method according to claim 1, wherein the sealer coating composition is capable of being dispersed in water or in an organic solvent and contains a resin selected from the group consisting a acyl resins, alkyd resins or polyester resins.

10. A method according to claim 9, wherein the sealer coated composition is a composition capable of being dispersed in water.

11. A method according to claim 9, wherein the sealer composition is a composition capable of being dispersed in an organic solvent and contains an organic solvent therein.

12. A method according to claim 9, wherein the metallic base coating applied to the sealer coating composition is applied by a wet-on-wet method.

13. A method according to claim 1, whrein the sealer coating composition is a thermosetting resinous coating composition.

14. A method according to claim 8, wherein the clear coating resinous composition contains a resin selected from the group cosnisting of alkyl resins, acryl resins, urethane resins, acryl-urethane resins, epoxy resins and polyester resins.

* * * * *